United States Patent [19]

Box

[11] Patent Number: 4,965,551

[45] Date of Patent: Oct. 23, 1990

[54] BURGLAR ALARM SYSTEM FOR MULTI-UNIT MAILBOXES

[76] Inventor: Richard Box, P.O. Box 165311, Irving, Tex. 75016-5311

[21] Appl. No.: 279,878

[22] Filed: Dec. 5, 1988

[51] Int. Cl.[5] ..... G08B 13/08

[52] U.S. Cl. ..... 340/545; 340/522; 340/542; 340/547; 340/569

[58] Field of Search ..... 340/542, 547, 569, 539, 340/522, 426, 430, 528, 825.31, 825.32, 545; 232/35-37; D99/32; 109/43; 70/432; 180/287; 307/10.2

[56] References Cited

U.S. PATENT DOCUMENTS

| | | | |
|---|---|---|---|
| 3,295,124 | 12/1966 | Burleson et al. | 340/545 |
| 3,636,485 | 1/1972 | Weathers | 340/547 X |
| 3,935,994 | 2/1976 | Darvishian | 340/569 X |
| 3,936,673 | 2/1976 | Kelly et al. | 340/426 X |
| 3,983,551 | 9/1976 | Raymond | 340/541 |
| 4,101,877 | 7/1978 | Rush | 340/569 |
| 4,807,455 | 2/1989 | Mauer | 70/277 |

*Primary Examiner*—Joseph A. Orsino
*Assistant Examiner*—Thomas J. Mullen, Jr.
*Attorney, Agent, or Firm*—Johnson & Gibbs

[57] ABSTRACT

Alarm system for multi-compartment, postal mailbox arrays incorporating a plurality of individual mail compartments contained behind a primary access door. The system comprises an alarm secured adjacent the mailbox array and coupled thereto by switches coupled to each access door and to the postal lock for that door. The postal lock is modified with an aperture which exposes the internal operation thereof for a switch mounted thereon. In this manner authorized actuation of the lock disengages the alarm system to prevent it from sounding when the access door is opened. Forced opening of the access door without first disengaging the system through the postal lock will otherwise set off the alarm. In this manner a number of access door switches may be coupled to a single alarm box which itself may be constructed for preventing unauthorized deactivation by the utilization of similar switch sensors disposed therein.

22 Claims, 3 Drawing Sheets

BURGLAR ALARM SYSTEM FOR MULTI-UNIT MAILBOXES

BACKGROUND OF THE INVENTION

1. Field of Invention

The present invention relates to security systems and, more particularly, to a postal mailbox alarm system for multicompartment mailbox arrays contained beneath a primary access door.

2. Background of the Invention

The prior art is replete with alarm systems of varying designs and applications. Such alarms are utilized throughout the prior art for both safety and protection of personnel and personal belongings. However, the advent of advanced electronic technology has precipitated a virtual revolution in the alarm industry. Many residential and commercial establishments are now protected by alarm networks of varying degrees of sophistication. In the main, these alarm networks are based upon the principal of remote sensors that detect the event of intrusion and permit the generation of an alarm signal. Such systems have found widespread commercial acceptance and success, particularly when the alarm may be installed during construction of homes, buildings and other regions to be "secured."

Security systems have also found application in smaller dwellings and structures. For example, alarm systems have been adapted specifically for automobiles. These alarms provide both audible announcement of intrusion as well as, in certain instances, disabling action of the vehicle. The most widely accepted alarm system of date is that of an acoustic alarm the signal of which is triggered by motion of the vehicle or voltage drop caused by vehicle interior lights turning on. This particular adaptation of conventional alarm technology has likewise found widespread commercial success.

The security and alarm structuring of smaller and/or portable areas such as vehicles has demanded various considerations not heretofore necessary for larger, more complex establishments such as homes and offices. In particular, it is necessary to provide such a system in a self contained assembly whereby power is provided within the system in a configuration that is not easily accessed. Automotive alarms therefore often utilize the automobile battery for power and the circuit thereof is contained within the vehicle in a configuration that is optimally not readily accessible to a car thief.

Certain applications which are readily available for alarm systems and which may utilize the advantages thereof include smaller security areas such as coin operated telephones. One such system is shown in U.S. Pat. No. 3,983,551. This 1976 patent teaches the use of a sensor mounted to the telephone housing adjacent a removable drawer type coin box. It is also well known that postal receptacles often contain valuable documents, money and other negotiable instruments which are attractive to thieves. This presents yet another type of security problem.

Conventional construction techniques for high density housing generally provide postal service deposit through multiunit mailboxes housed behind a primary access door, also known as a master loading door. The access door is accessible only by a postal worker due to a looking system installed thereon and regulated by the postal service. By accessing this primary door, the postal service has access to a multitude of postal compartments, or boxes, for the individual residences represented thereby. Each residence has its own means of access to this particular box, generally through a separate key which accesses only that box. In many instances this access entry is through a customer compartment door within the master loading door. However, when a thief desires access to the postal boxes as a group, he must simply break through the single, large master loading door to then have available to him all of the individual postal compartments, or boxes. This simplifies the thief's goal in obtaining access to mail and other valuables contained in these deposit receptacles. In most cases the thief does not violate the individual postal doors to each mailbox, but instead the very large access door to the mailbox array, it is not practical for the individual postal box owners, or residents, to provide security therefor. Since the overall access door is locked only by a postal service lock that is not in itself made available for triggering and deactivating an alarm system, it has been, to date, difficult to provide an effective alarm system for such multi-unit mailbox arrays. This is particularly true in view of the fact that existing postal procedures do not permit mail carriers to carry extra keys to turn off and on security alarms. This would be not only an added responsibility, but also an added potential liability.

It would be an advantage therefore to overcome the problems of the prior art by providing an alarm system that would conform to existing postal procedures and yet permit a low cost and yet efficient manner of protecting multiple mailbox compartments contained behind a single postal access door. It is well known that such postal access doors are secured by a lock generally of a single design controlled by the postal service. By accessing the operation of this lock, an alarm system can be installed which controls the unauthorized use of the access door and generates an alarm signal responsive to unauthorized entry.

SUMMARY OF THE INVENTION

The present invention relates to a mailbox alarm system for a multi-unit receptacle array. More particularly, the present invention comprises an alarm, and means for activating the alarm in response to unauthorized entry through the access door of the receptacle array. The means for generating the alarm include a power source, a first sensor disposed between the access door and the receptacle, or mailbox array to detect the opening and closing of the access door, and a second sensor disposed adjacent the postal lock for detecting the authorized actuation of the look for deactivating the alarms system.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
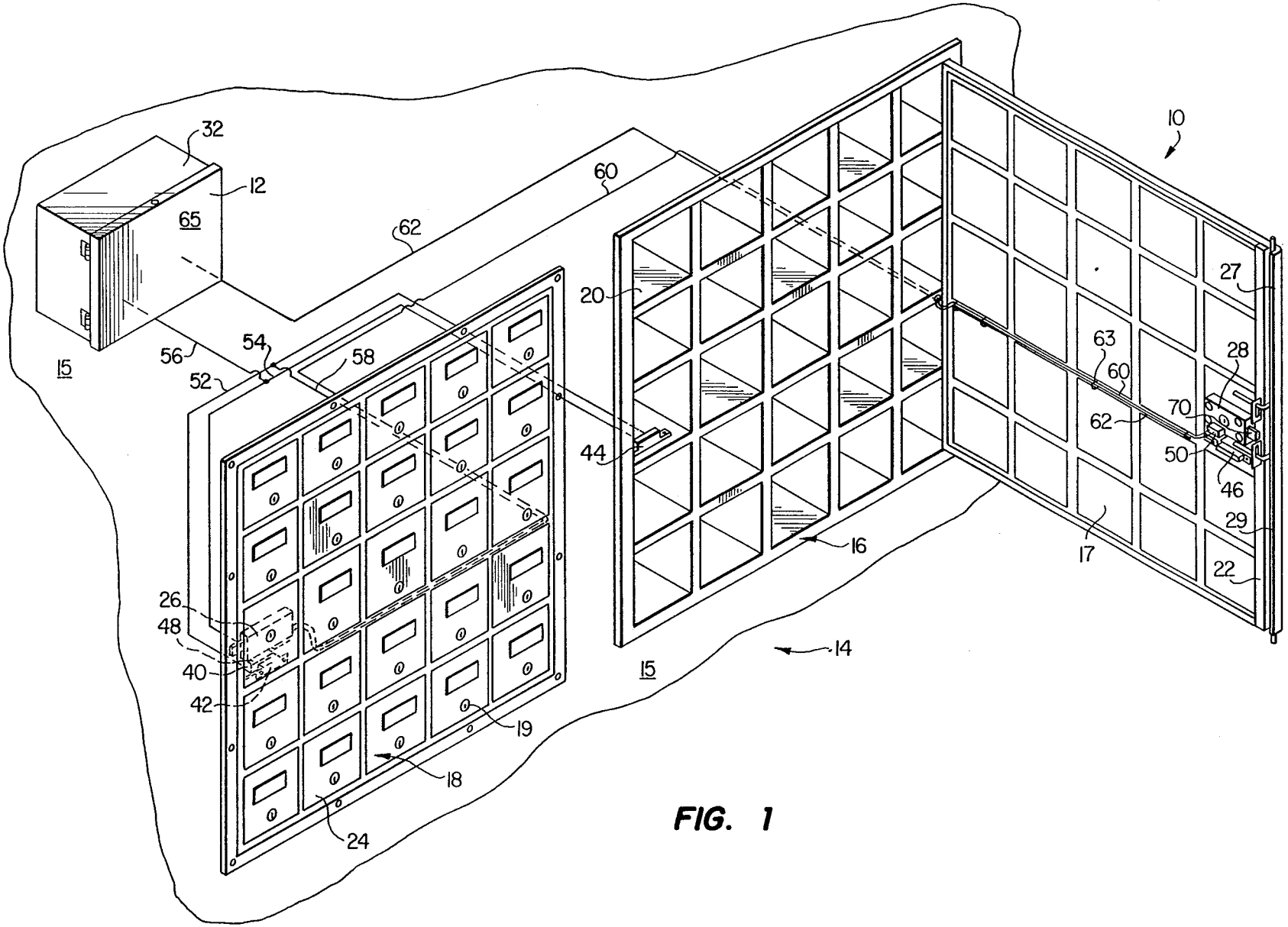
FIG. 1 is a perspective view of a multi-unit mailbox array and postal lock alarm system therefor constructed in accordance with the principles of the present invention.

Referring first to FIGURE there is shown a multi-unit mailbox burglar alarm system 10 for mailbox arrays, constructed in accordance with the principles of the present invention. The system 10 comprises an alarm unit 12 secured adjacent a multiunit mailbox array 14. The mailbox array 14 includes first and second multi-compartment panels 16 and 18, although any number of panels may be incorporated. The panels 16 and 18 are secured to a wall 15 by conventional securement means, generally including a plurality of threaded fasteners or the like. The panels 16 and 18 each include a mail slot/-compartment array 20 disposed behind access doors 22 and 24. The access doors 22 and 24 include a plurality of individual compartment doors 17 and 19, respectively. The doors 17 and 19 are utilized by individual owners of the residence or business served by the postal service.

The postal service accesses the various compartments 20 of panels 16 and 18 through the access doors 22 and 24. Residents then access the individual compartments 20 by utilizing a separate key which fits select ones of the individual doors 17 and 19 providing access to the mail stored therein. Access to the compartments 20 is made possible by standard postal locks 26 and 28 secured to the access doors 24 and 22, respectively, for which only the postal service has the key. Actuation of the lock 26 exposes access door locking linkage 27 and 29. These linkage members are manually actuatable to allow the access doors 22 and 24 to swing outwardly as shown herein. In this manner the postal service may easily and conveniently fill the individual compartments 20 for private access by the individual owners or occupants having keys thereto. The obvious problem is that a thief attempting to gain from mail theft can easily access all compartments by simply breaking through the single access doors 24 and 22. The present invention 10 provides a reliable form of alarm for unauthorized opening of access doors 24 and 22 and/or tampering with the system 10.

Figure 4:
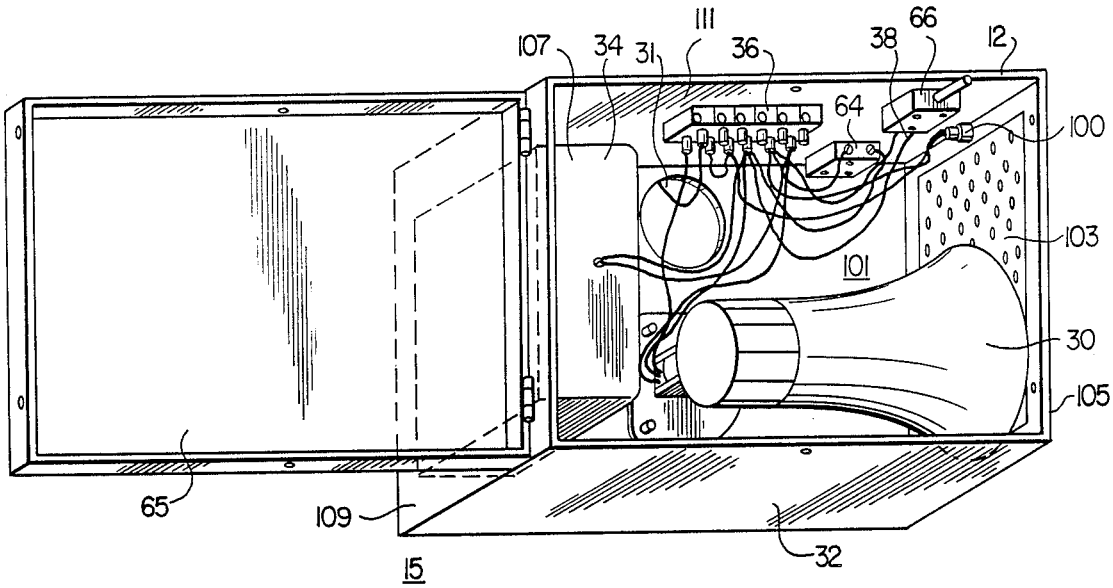
FIG. 4 is an enlarged perspective view of the alarm box of FIG. 1 constructed in accordance with the principles of the present invention and shown with the front door opened to reveal the assembly therein.

Referring now to FIG. 4, the alarm system 10 includes an alarm generating means secured within a housing 32 securely affixed adjacent the multi-unit mailbox array 14. The alarm generating means may include an electrical connection 31 to telephone lines coupled to the police or an alarm monitoring station, or simply acoustic horn 30. A separate power supply, such as battery 34 is preferably housed within the housing 32 for providing continuous power to the alarm circuit. A circuit interconnection terminal board 36 is provided for necessary electrical interconnection and/or signal generation. In this manner a plurality of sensors may be installed within the panels 16 and 18, wired thereto by a wiring network 38, and the necessary alarm signal or signals generated therefrom.

Referring now to FIGURES and 4 in combination, wiring network 38 interconnects a plurality of sensors for detecting unauthorized opening of the access doors 22 and 24. Primary in this network 38 is a sensor for detecting the condition of the open or close position of the respective access doors. In this regard, a normally closed sensor 40 of the magnetic switch variety is disposed behind access door 24 of panel 18 for sensing the position of a magnetic member 42 disposed on the opposite thereto when said door is in the closed position. This closed position opens normally closed sensor 40. Likewise, a normally closed magnetic sensor, or switch 44 is disposed in panel 16 opposite a magnetic member 46 secured in door 22 whereby the closed condition of the doors 24 and 22 cause the network 38 to see an open position of said switches. Opening of the doors 24 and 22 cause each of the switches 40 and 44 to close and produce a potential alarm signal as described in more detail below. Authorized entry through access doors 24 and 22 is monitored by a second type of sensor mounted to the standard postal locks 26 and 28. It is this sensor, described in greater detail below, which affords reliability and effectiveness in the alarm system 10 of the present invention.

Still referring to FIGS. 1 and 4, sensors 48 and 50 are secured to postal locks 26 and 28 to thereby detect the authorized actuation thereof. These sensors are of the normally closed variety and are mounted to said locks on the doors 16 and 18 so that authorized actuation thereof produces an open condition in the network 38. Sensors 48 and 50 are thus disposed in series communication while sensors 40 and 44 are disposed in parallel communication, this will be described in more detail below. Sensors 40 and 44 are coupled by wires 52 and 54 in parallel so that closure of either one can activate an alarm signal. Wires 56 and 58 are coupled thereto also in parallel with wire 56 coupled directly to terminal block 36 and wire 58 coupled in series to one side of sensor 48. The other side of sensor 48 mounted to postal lock 26 is coupled to by wire 60 in series to sensor 50 coupled to postal lock 28. Second wire 62 thus carries the series connection from the postal lock sensors to the terminal block 36 of the alarm unit 12. Wiring cable connectors 63 are preferably used to secure wires 60 and 62 to the door 22 in a convenient fashion. This allows for the proper sensing actuation control of the alarm in a manner affording reliability and effectiveness. To further enhance the system additional sensors 64 and 66 are mounted within the alarm box housing 32 to detect tampering, such as any unauthorized opening of the access door 65 thereof or the attempted removal of the box 32 from the underlying wall 15. Likewise other sensors may be incorporated in accordance with the principles of the present invention.

Figure 2:
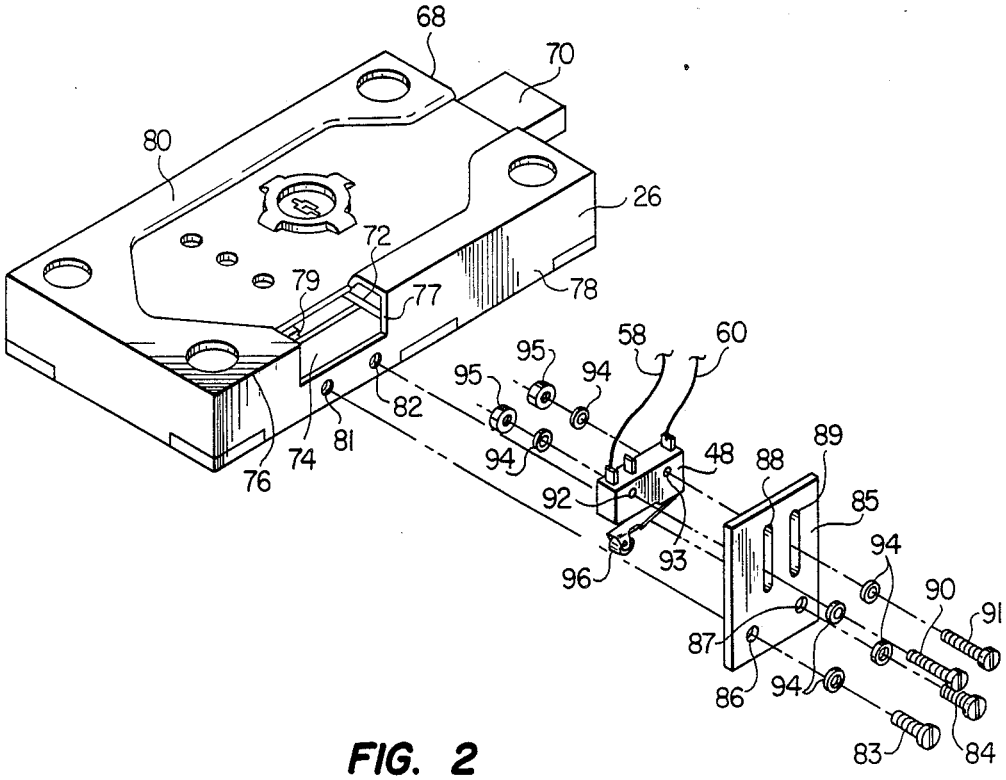
FIG. 2 is an enlarged perspective view of the postal lock of FIG. 1 showing the modification thereof in accordance with the principles of the present invention.

Referring now to FIG. 2, there is shown a standard postal lock 26 which has been modified in accordance with the principles of the present invention with sensor 48 shown attached thereto in an enlarged exploded perspective view. It should be noted that the assembly shown in FIG. 2 is for purposes of illustration and an identical assembly is constructed for postal lock 28 in sensor 50. The postal lock 26 comprises a standard rectangular housing 68 having a latch mechanism 70 installed therein. The latch mechanism linkage 72 is exposed in this particular embodiment by the fabrication of a slotted region 74 along edge 76 thereof. The slotted region 74 is generally rectangular in shape having a side rectangular region 77 cut away from side 78 of the housing 68 and a top edge region 79 cut away from top surface 80 of housing 68. In this particular construction a channel section of generally L-shaped cross section has been removed. However, it should be noted that in any particular lock configuration the housing section that must be removed may vary. It is this particular channel section, however, that exposes the particular linkage area in the lock 26 that has been found convenient for triggering the sensor 48 in accordance with the principles of the present invention. Other linkage areas may likewise be incorporated and/or other attachment mechanisms used within the spirit and scope of the present invention.

Still referring to FIG. 2, it should be noted that this particular view of the lock 26 illustrates the further modification of the side wall 78 in the form of two threaded apertures 81 and 82. These apertures are adapted for receipt of threaded fasteners 83 and 84 respectively. A mounting bracket 85 having first and second apertures 86 and 87 is constructed for making engagement therewith. The mounting bracket 85 further includes first and second slots 88 and 89 adapted for receiving threaded fasteners 90 and 91. The threaded fasteners 90 and 91 are sized to permit securement of sensor 48 to apertures 92 and 93 formed therein. Appropriate washers 94 are shown for purposes of standard threaded mounting and likewise threaded nuts 95 are shown for securement of the sensor 48 to the mounting bracket 85. It should be noted that other mounting techniques, other mounting arrays, and other sensor configurations can be utilized in accordance with the principles of the present invention. This particular configuration permits an adjustment of the sensor 48 relative to the housing 28 in the direction of the slots 88 and 89 for purposes of appropriately engaging the sensor 48 and the linkage 72.

Referring still to FIG. 2, the sensor 48 is seen to be constructed with wires 58 and 60 extending therefrom. The wires are labelled accordingly for purposes of illustration, and it should be noted that sensor 48 is preferably of the subminiature roller lever switch variety whereby the electrical connection terminals are already provided therewith. These terminals and/or wires extend therefrom connect to the appropriate sections of the interconnect network 38 for which wires 58 and 60 are shown herein for purposes of illustration and as referred to in FIGURE 1. The critical portion of the sensor is not only the interconnecting network of wires 58 and 60 but the sensor mechanism 96 depending therefrom. It is the sensor mechanism 96 that engages the linkage 72 shown exposed in FIG. 2 and it is this sensor that determines authorized access through the access door 24. As described above, sensor 48 is normally closed when the lock 26 is in the "lock" position shown in FIG. 2, with the latch mechanism 70 extended therefrom. It is in this condition that the door 24 remains closed and locked in protection of the compartments 20 there behind. In this mode the portion of the circuit 38 through this sensor remains closed and permits the flow of electricity in the event any of the sensors coupled thereto are activated as described in more detail below.

Figure 3:
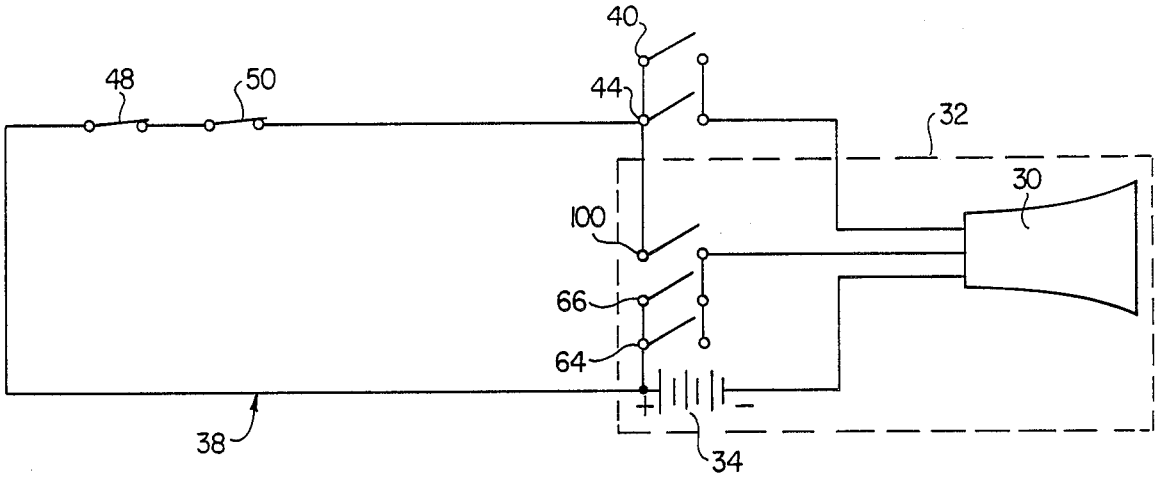
FIG. 3 is an electronic schematic of the alarm system of the present invention.

Referring now to FIG. 3 there is shown a schematic diagram of the alarm system 10 of FIGURE The network 38 is illustrated in the schematic diagram with the power supply 34 shown in the form of a standard battery. Normally closed sensors 48 and 50 are represented by the switches disposed on the top section of the schematic. The access door position sensors 40 and 44 are likewise shown as standard switches in an open mode. These switches are maintained in an open mode in the present invention by the utilization of the magnetic strips 42 and 46 as described above. With the magnetic strips 42 and 46 disposed adjacent said sensors and in close proximity thereto, the switches remain open. It is when the magnetic strips 42 and/or 46 are removed therefrom, as when the doors 22 and 24 are opened, that the switches are closed. It may be seen, however, that in the event that locks 26 and 28 are properly actuated with a key whereby the linkage 72 actuates the sensor 96, the switches 48 and 50 will open to prevent the alarm circuit from making a complete loop to generate an alarm signal and actuate the alarm horn 30. Alarm horn 30 is thus shown connected to the switches 40 and 44 which are disposed in parallel relationship one with the other. A separate set of alarm switches are incorporated in conjunction with the horn. These switches may include tamper sensors 64 and 66 and are likewise disposed in parallel. If either one is actuated it will cause a closing of the network 38 to actuate the horn 30.

Still referring to FIG. 3, this relatively standard schematic diagram further incorporates a switch 100. This switch may be used to test the circuit, the power supply 34 and the horn 30. The housing 32 is likewise shown by the dotted lines around switches 64, 66 and 100 and horn 30 for purposes of illustrating the operation thereof. Power supply 34 is likewise included within the dotted lines 32 as is shown in FIG. 1. In this configuration the multi-unit array of compartments 20 contained behind a single access door of the type shown herein may be protected in a reliable and economical fashion.

Referring now to FIG. 4, there is shown a perspective view of the alarm box 32 of FIG. 1 with the front door 65 thereof shown in the open position. In this position the alarm horn 30 is shown assembled therein and secured against a back wall 101. A perforated screen 103 is shown on one end 105 for allowing the horn 30 to generate an acoustic signal therethrough. A battery casing 107 is shown assembled to end wall 109. A conventional battery 34 is stored within the battery casing 107 for providing power to the system 10. The terminal board 36 is shown assembled to an upper wall 111 of the box 32 for receiving the interfacing the wires 38 of the alarm unit 12.

Referring still to FIG. 4, first and second "tamper" sensors 64 and 66 are secured to the top 111 of the box 32 for detecting either the unauthorized opening of the frontal door 65 or the attempted removal of the box 32 from the wall 15 therebehind. In either case these conventional sensors are able to detect such movement to again generate an alarm signal consistent with the underlying principle of the present invention.

Figure 5:
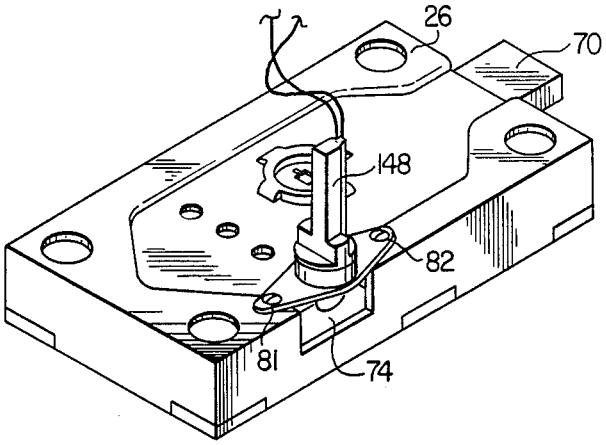
FIG. 5 is an enlarged perspective view of the postal lock of FIG. 1 showing an alternative embodiment of an actuation sensor assembled thereto in accordance with the principles of the present invention.

Referring now to FIG. 5, there is shown a perspective view of the postal look 26 with an alternative embodiment of a sensor assembled thereto. Sensor 148 is a one piece alarm contact attached directly to the modified lock 26. It is thus shown secured thereto with threaded apertures 81 and 82 formed in another portion of the look 26. Other assemblies would, of course, be within the scope of the present invention, such as a sensor built into the postal lock 26 without the need for modification.

It should be noted that although an acoustic-alarm unit 12 is shown herein, it is contemplated to incorporate a variety of master controls for conventional alarm systems. For example, master controls that are connected to telephone lines for signalling police upon activation are specifically compatible with the present system 10. Such controls would provide yet a higher degree of security.

It is thus believed that the operation and construction of the invention will be apparent from the foregoing description. While the apparatus thereof shown and described has been characterized as being preferred, it will be obvious that various changes and modifications may be made therein without departing from the spirit and scope of the invention as defined in the following claims:

I claim:

1. A multi-unit mailbox alarm system for generating an alarm signal in response to the unauthorized opening of an access door disposed over a plurality of mailbox compartments, said door being secured by a postal lock of the type having linear actuation linkage therein, and said alarm system comprising:

a first sensor disposed between said access door and said mail compartments therebehind;

a second sensor disposed relative to said postal lock for detecting the linear actuation thereof;

an interconnection coupling said first sensor to said second sensor for relaying the state of said second sensor disposed relative to said postal lock, said interconnection being disposed relative to said first sensor and said second sensor; and means for generating an alarm signal in response to sensing the unauthorized opening of said access door through said first sensor without first actuating said second sensor through said postal lock and transmitting the state of said second sensor through said interconnection to said first sensor.

2. The apparatus set forth in claim 1 and further including an alarm horn secured adjacent said mailbox array and electrically coupled to said sensors.

3. The apparatus set forth in claim 1 wherein said alarm system further includes a power supply incorporated therewith and providing means for detecting signals from said first sensor having said interconnecting with said second sensor and for generating said alarm signal.

4. The apparatus set forth in claim 1 wherein said alarm system further comprises a box secured adjacent said multi-unit mail box compartments and having a power supply and a horn secured therein and coupled to said first sensor having said interconnection with said second sensor.

5. The apparatus set forth in claim 4 wherein said box further includes at least one sensor installed therein for detecting the unauthorized movement of said box.

6. The apparatus set forth in claim 1 wherein said first sensor is of the normally closed variety and is adapted to open when said access door is closed.

7. The apparatus set forth in claim 6 wherein said first sensor is a magnetic switch.

8. The apparatus set forth in claim 7 wherein said magnetic switch is electrically interconnected with said second sensor.

9. The apparatus set forth in claim 1 wherein said second sensor is of the normally closed variety and opens when said postal lock is actuated.

10. The apparatus set forth in claim 9 wherein said second sensor is electrically interconnected with said first sensor.

11. The apparatus set forth in claim 10 wherein said electrical interconnection carries the state of said second sensor to said first sensor.

12. The apparatus set forth in claim 11 wherein said electrical interconnection is disposed proximate to said multi-unit mail box compartments and between said first and second sensors.

13. The apparatus set forth in claim 9 wherein said second sensor is a switch mounted to said postal lock.

14. The apparatus set forth in claim 13 wherein said switch is mounted to said postal lock to detect the position of said linear actuation linkage therein.

15. The apparatus set forth in claim 14 wherein said postal lock has an aperture cut therein for exposing said linear actuation linkage therein and wherein said switch is assembled thereto for engagement of said linear actuation linkage therein.

16. The apparatus set forth in claim 15 wherein said linear actuation linkage of said postal lock linearly extends and linearly retracts and wherein said linear extension and retraction triggers said switch assembled thereto and interconnected with said first sensor.

17. The apparatus as set forth in claim 1 wherein said means for generating an alarm signal in response to sensing the unauthorized opening of said access door includes means for transmitting said alarm signal to a remote location for notifying individuals of the need for assistance.

18. The apparatus as set forth in claim 17 wherein said means for transmitting said alarm signal to a remote location includes existing telephone lines for carrying said alarm signal to said remote location.

19. A method of generating an alarm signal in response to the unauthorized opening of an access door disposed over a plurality of mailbox compartments with said door being secured by a postal lock the type having linear actuation linkage therein, said method comprising the steps of:

providing a first sensor;

disposing said sensor relative to said access door to detect the opening thereof;

providing a second sensor;

disposing said second sensor relative to said postal lock for detecting the actuation thereof;

providing an interconnection coupling said first sensor to said second sensor;

disposing said interconnection relative to said first sensor and said second sensor; and providing means for generating an alarm signal in response to sensing the unauthorized opening of said access door through said first sensor without first actuating said second sensor through said postal lock and transmitting the state of said second sensor through said interconnection to said first sensor.

20. The method as set forth in claim 19 further including the step of providing an alarm horn and securing said horn adjacent said mailbox compartments in electric coupling to said sensors.

21. The method as set forth in claim 19 and further including the step of cutting an aperture in said postal lock and exposing said actuation linkage therein for engagement by said second sensor.

22. The method set forth in claim 19 further including the step of providing an electrical interconnection coupling said first sensor with said second sensor.

* * * * *